US007740415B1

(12) United States Patent
Crites

(10) Patent No.: US 7,740,415 B1
(45) Date of Patent: Jun. 22, 2010

(54) MANHOLE CUTTING AND REMOVING DEVICE

(76) Inventor: Michael Crites, 556 Honeysuckle Bend, Lima, OH (US) 45807

( * ) Notice: Subject to any disclaimer, the term of this patent is extended or adjusted under 35 U.S.C. 154(b) by 320 days.

(21) Appl. No.: 11/900,583

(22) Filed: Sep. 13, 2007

Related U.S. Application Data

(63) Continuation-in-part of application No. 11/657,739, filed on Jan. 25, 2007.

(51) Int. Cl.
*E21C 25/00* (2006.01)
*E01C 23/088* (2006.01)

(52) U.S. Cl. ..... 404/94; 299/39.1; 299/39.3; 404/25; 175/5

(58) Field of Classification Search ..... 404/90, 404/93, 94, 25; 299/36.1, 39.1, 39.3; 175/57, 175/5

See application file for complete search history.

(56) References Cited

U.S. PATENT DOCUMENTS

| | | | | |
|---|---|---|---|---|
| 4,332,299 | A * | 6/1982 | Parks et al. | 172/98 |
| 4,924,951 | A | 5/1990 | Paulson | |
| 4,968,101 | A | 11/1990 | Bossow | |
| 5,470,131 | A | 11/1995 | Nolan et al. | |
| 6,536,987 | B2 | 3/2003 | Chang | |
| 6,709,064 | B2 | 3/2004 | Nettck | |
| 6,755,481 | B2 * | 6/2004 | Katsumoto | 299/36.1 |

* cited by examiner

*Primary Examiner*—Raymond W Addie
(74) *Attorney, Agent, or Firm*—Harpman & Harpman

(57) ABSTRACT

A device to secure, cut and sequentially remove a manhole from a street environment. The manhole removing device is supported and rotatably driven hydraulically by a mobile operation equipment. A circular disk assembly has adjustable pavement cutters adjustably positioned from there within inter-related manhole centering and a locking alignment and engagement plate assembly define a one-step cutting and removal of an existing manhole from the street for replacement.

4 Claims, 8 Drawing Sheets

MANHOLE CUTTING AND REMOVING DEVICE

This is a continuation in part application of Ser. No. 11/657,739, filed Jan. 25, 2007.

BACKGROUND OF THE INVENTION

1. Technical Field

This device relates to automated digging machines that have been developed to engage, cut and remove manholes found in street environments. Such machines typically cut the interior casing of the manhole in preparation for removal, repair and replacement due to changes in street elevations associated with resurfacing or repair and replacement.

2. Description of Prior Art

Prior art devices of this type have relied on a variety of cutting and removal devices, see for example U.S. Pat. Nos. 4,924,951, 4,968,101, 5,470,131, 6,536,987, 6,709,064 and 6,755,481.

U.S. Pat. No. 4,924,951 claims a manhole cutter for cutting a fixed diameter circular groove of a fixed depth around the surface of a manhole. The cutter is of a continuous ring design with spaced sections having cutting teeth elements.

A vertical asphalt and concrete milling device is illustrated in U.S. Pat. No. 4,968,101 having a large circular cutting drum with continuous teeth along the bottom edge.

In U.S. Pat. No. 5,470,131 a method and apparatus for cutting circular slots in pavements extending about a manhole casing is disclosed in which a self-propelled core cutting device has an open drum shaped cutting blade which is rotated by a hydraulic drive means to engage and cut the surface about an existing manhole.

U.S. Pat. No. 6,536,987 discloses a quick manhole/manhole construction method and related device in which a cutting unit is positioned within the manhole and the cuts using a circular saw for removal thereof.

U.S. Pat. No. 6,709,064 is directed towards a method and device for detaching or cutting an embedded manhole frame that positions a circular cutting saw blade within the manhole so as to cut from the inside the existing hole casing for removal.

U.S. Pat. No. 6,755,481 claims a method for cutting asphalt or concrete around a manhole using a circular offset cutting blade.

SUMMARY OF THE INVENTION

An automatic manhole removing tool for use with a mobile power take-off that cuts and removes a manhole assembly from a street surface for replacement. The tool self-centers and secures within the manhole using adjustable blade elements to cut a circular groove about the manhole and therein remove same. An adjustable manhole engagement assembly provides multiple adjustable arcuate engagement cams that engage and hold the cutting tool within the interior casing of the manhole to be removed. A central swivel bearing allows the assembly to accommodate uneven street surfaces during use.

DETAILED DESCRIPTION OF THE INVENTION

Figure 1:
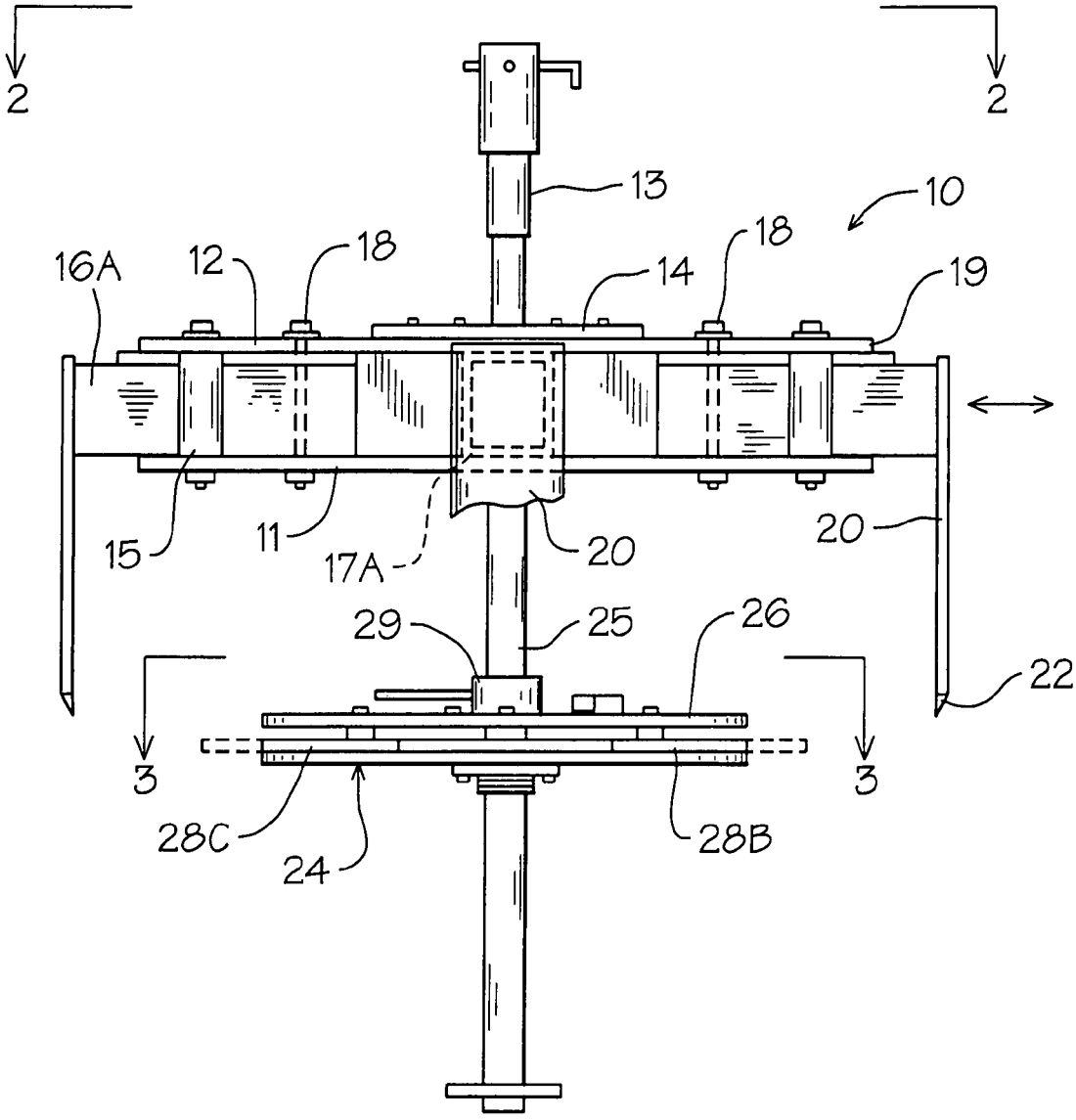
FIG. 1 is a side elevational view of the manhole removing device of the invention.
Figure 2:
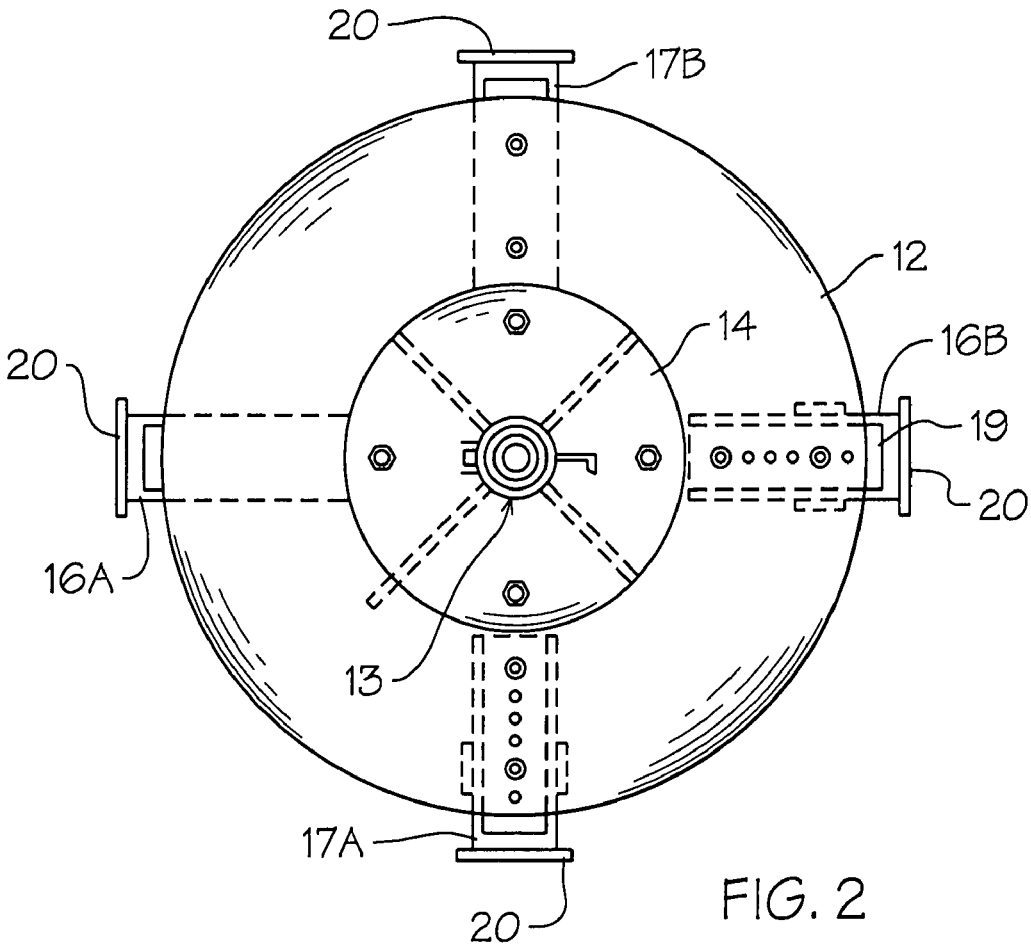
FIG. 2 is a top plan view on lines 2-2 of FIG. 1.

Referring to FIG. 1 of the drawings, a manhole removal tool 10 of the invention can be seen having a pair of vertically spaced and aligned main support frame disks 11 and 12 secured to a central drive shaft assembly 13. The upper disk 11 has a reinforced plate 14 with a plurality of interconnection and guide brackets 15 extending between and securing the support frame disks 11 and 12 together. Pairs of oppositely disposed aligned cutting blade mounting arms 16A, 16B and 17A and 17B are slidably positioned between respective support frame disks 11 and 12 and some of the guide brackets 15. Each of the mounting arms 16A and 17B are of a tubular construction having a plurality of longitudinally and transversely aligned adjustable adjustment apertures A therein with a pair of spaced corresponding apertures A1 in their respective upper and lower support frame disks 11 and 12. Locking nut and bolt assemblies 18 are secured therethrough providing for incremental longitudinal adjustment of each of the mounting arms 16A and 16B and 17A and 17B extending from between the respective support frame disks 11 and 12. To provide additional support and spacing requirements for the arms apertured reinforcement plates 19 are positioned between each of the respective arm pairs 16 and 17 and the upper support frame disk 11.

Figure 6:
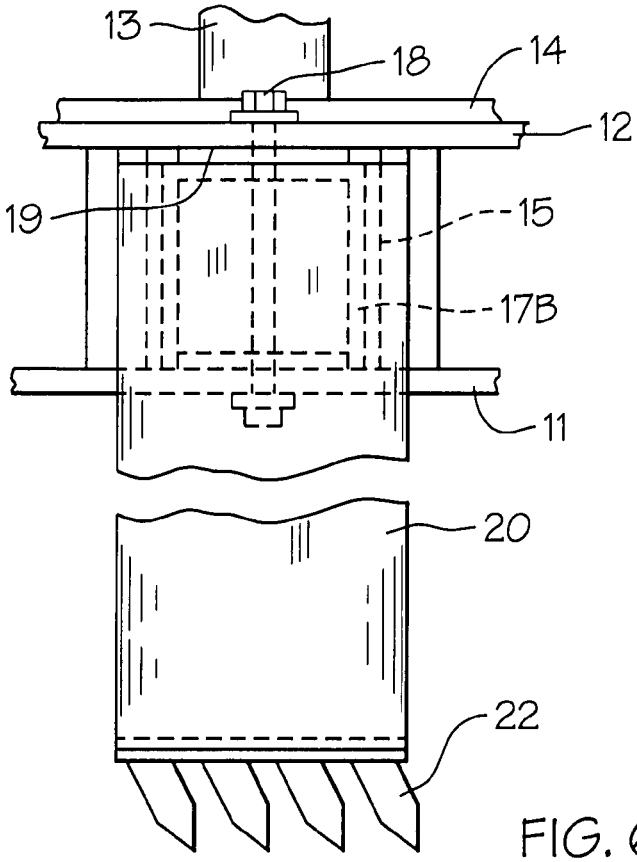
FIG. 6 is an enlarged side elevational view with portions broken away of a cutting blade of the invention.
Figure 7:
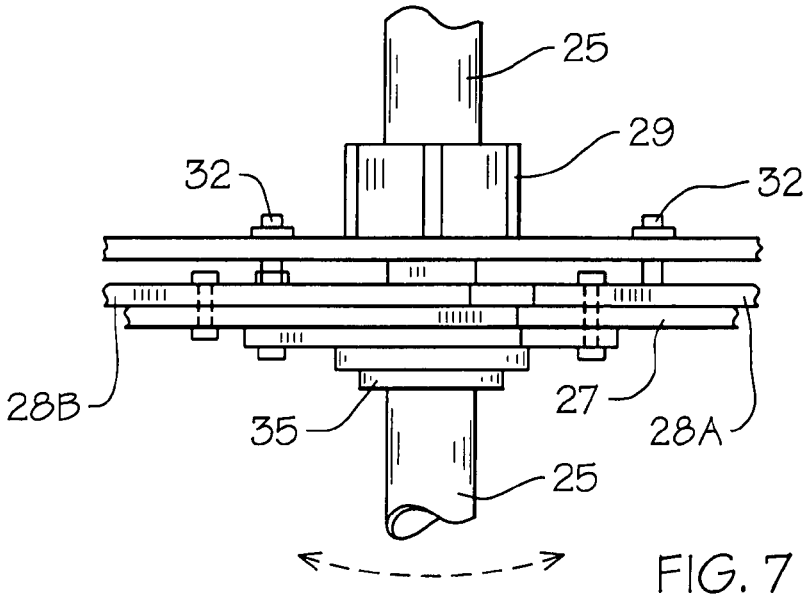
FIG. 7 is an enlarged side elevational view with portions broken away of the adjustable manhole engagement portion of the invention.

Cutting blades 20 are secured to the free ends at 21 of each of the arms extending downwardly therefrom with a plurality of hardened cutting teeth 22 which are welded in longitudinally spaced relation to one another on each of the arms oppositely disposed ends thereof as best seen in FIG. 6 of the drawings.

It will be seen that by adjustably repositioning the mounting arms 16A and 16B and 17A and 17B equally the effective cutting diameter of the attached cutting blades 20 when driven circularly in respect of the diameter of a manhole 23 to be removed as seen graphically in FIG. 8 of the drawings and will be described in greater detail hereinafter.

Referring now to FIGS. 1, 3, 4 and 5 of the drawings, a locking alignment assembly 24 is provided on a main support shaft 25 in spaced vertical relation to the main support frame disks 11 and 12 for engagement within the interior I of the manhole 23 to be removed. The locking and alignment assembly 24 has a pair of circular mounting plates 26 and 27 with multiple extendable cam elements 28A, 28B, 28C, and 28D pivotally secured therebetween.

Figure 3:
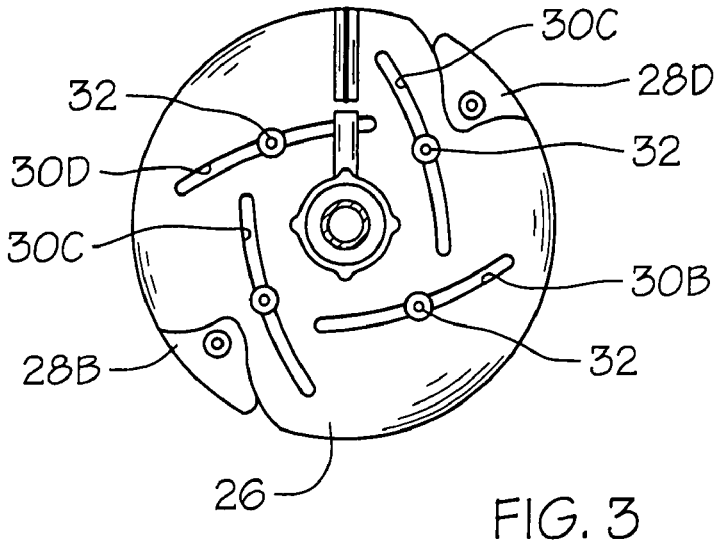
FIG. 3 is a top plan view on lines 3-3 of FIG. 1.
Figure 4:
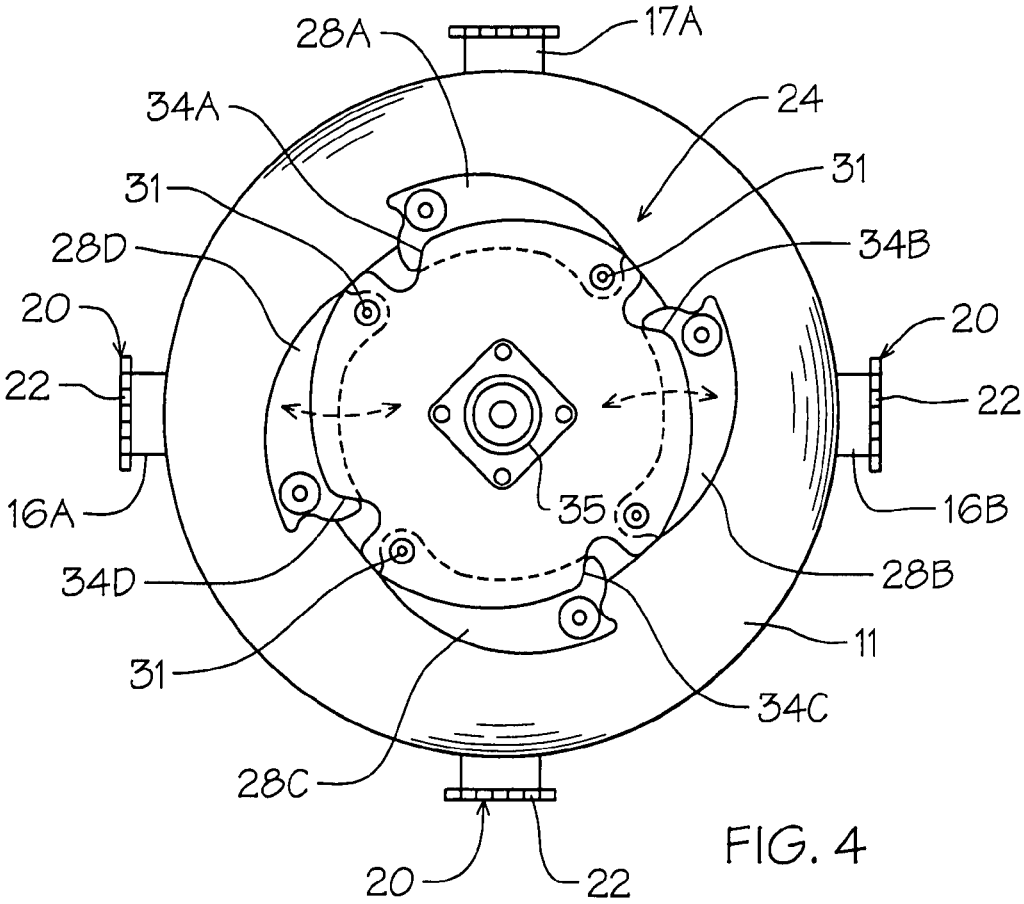
FIG. 4 is a bottom plan view of the device with manhole engagement cams extended.
Figure 5:
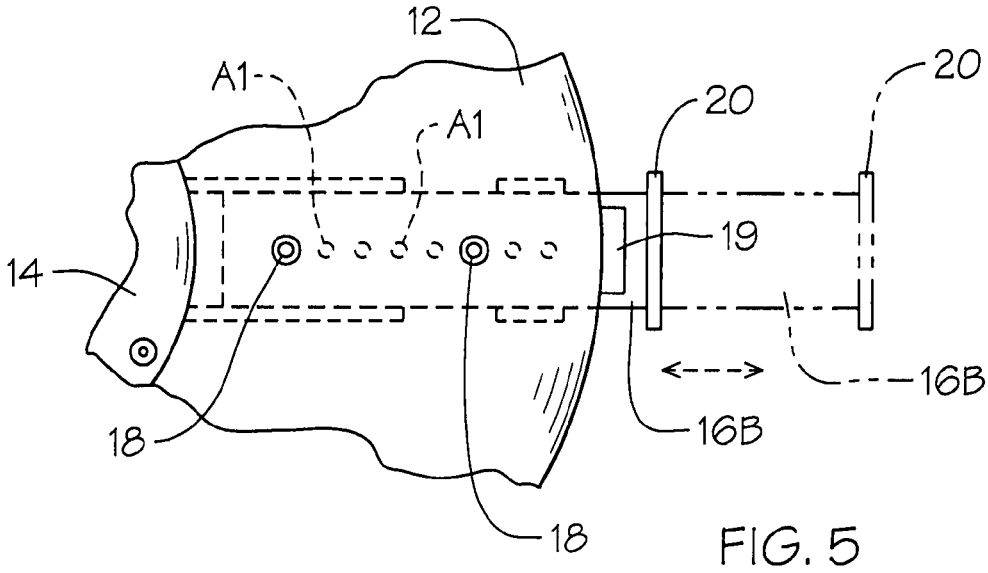
FIG. 5 is an enlarged partial top plan view of an adjustable cutting arm of the invention.

The upper mounting plate 26, best seen in FIG. 3 of the drawings, has a central aperture with an upstanding transfer collar 29 thereabout and a series of arcuate cam adjustment slots 30A, 30B, 30C and 30D therein. The cam elements 28A, 28B and 28C are pivotally secured to the lower plate 27 via pivot attachment pins 31, best seen in FIG. 4 of the drawings.

Adjustment deployment guide bolt assemblies 32 extend from each of the cam elements 28 and are slidably disposed within the corresponding adjustment slots 30A, 30B, 30C and 30D as hereinbefore described. The upper mounting plate 26 has contoured activation access notches 33A and 33B while the lower plate 27 has oppositely disposed notch pairs 34A and 34B and 34C and 34D to accommodate the pivoted displacement of the respective cam elements 28 as shown in broken lines in FIG. 3 of the drawings.

Referring now to FIGS. 9-13 of the drawings, an alternate improved alignment locking assembly 35 can be seen that will be positioned on the main support shaft 25 of the cutting device in the same spaced orientation within the assembly as that of the primary locking and alignment assembly 24 as hereinbefore described.

Figure 11:
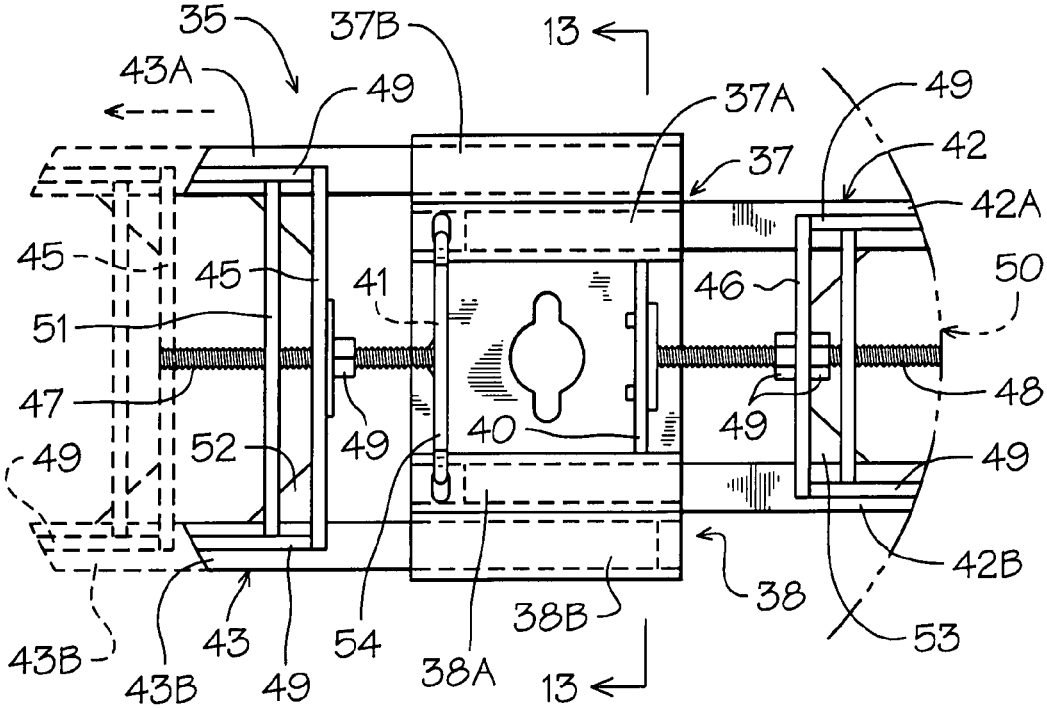
FIG. 11 is a top plan view of the locking alignment assembly.
Figure 12:
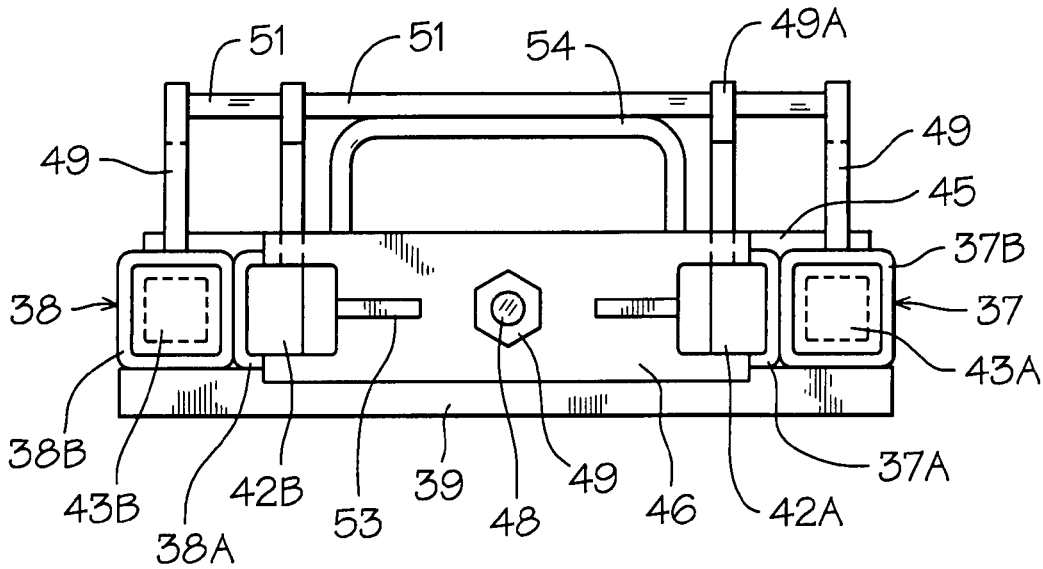
FIG. 12 is an end plan view on lines 12-12 of FIG. 10.
Figure 13:
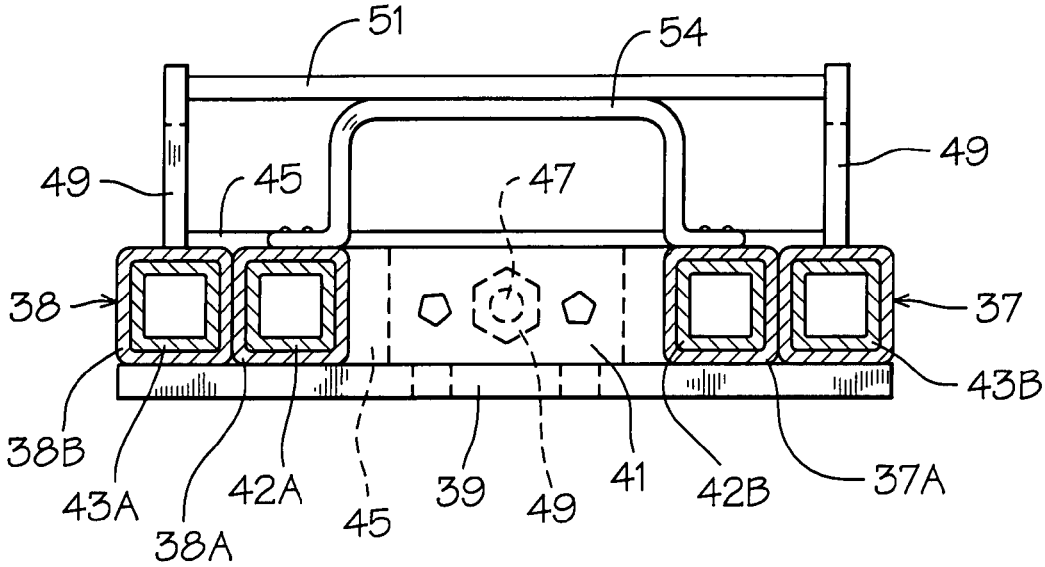
FIG. 13 is a cross-section view on lines 13-13 of FIG. 11.

The alternate alignment and locking assembly 35 has a main support frame 36 with spaced parallel guide tube pairs 37 and 38 secured on a mounting platform 39 as best seen in FIGS. 11 and 13 of the drawings. Apertured base plates 40 and 41 extend between and are secured to the inner facing tubes 37A and 38A of the respective guide tube pairs 37 and 38.

A pair of adjustable manhole engagement arm assemblies 42 and 43 are slidably disposed from within the respective guide tube pairs 37A and 38A and 37B and 38B respectively.

Each of said engagement arm assemblies 42 and 43 are secured to one another by reinforcing plates 45 and 46 having respective threaded rods 47 and 48 adjustably extending therethrough. The threaded rods extend from and are fixed to the respective aperture base plates 40 and 41 as hereinbefore described.

Locking nuts 49 are threadably positioned on the respective rods 47 and 48 engaging the corresponding plates 45 and 46 allowing for longitudinal repositioning of their interconnected engagement arm assemblies 42 and 43 from within the hereinbefore described guide tube pairs 37 and 38.

Figure 9:
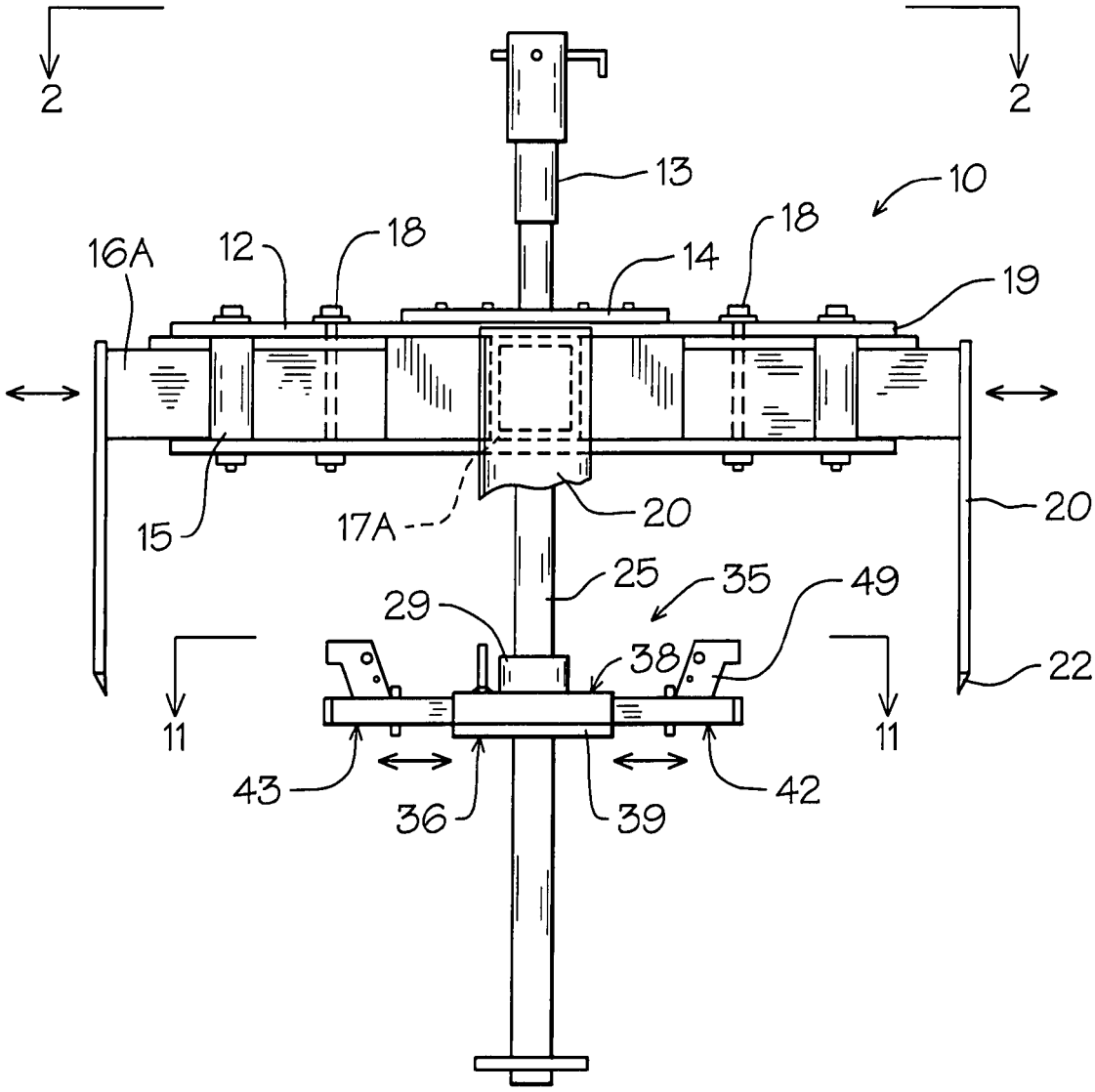
FIG. 9 is a side elevational view of an alternate assembly of the manhole removing device illustrating an improved locking alignment assembly.
Figure 10:
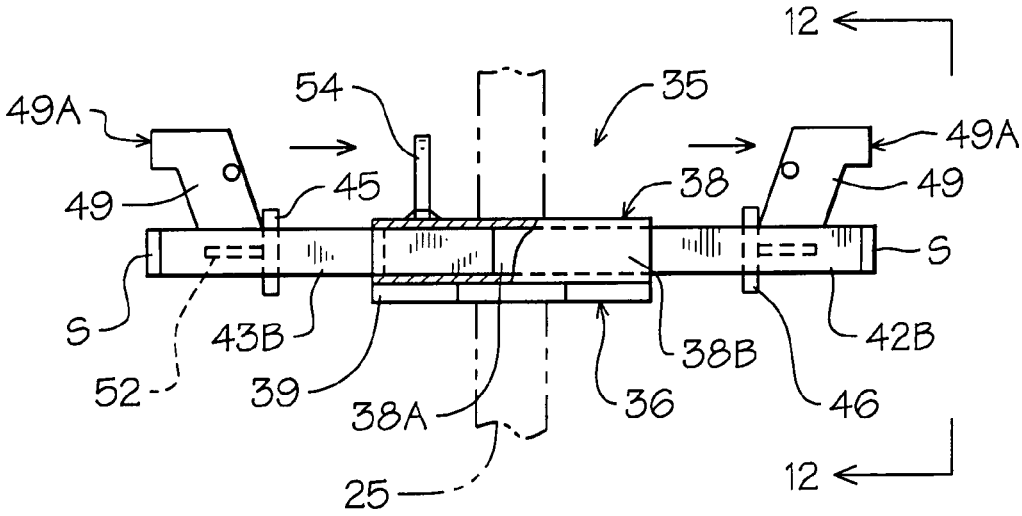
FIG. 10 is an enlarged side elevational view of the locking alignment assembly with portions broken away.

The arm assemblies 42 and 43 comprise tubular arm elements 42A and 42B and 43A and 43B respectively each of which has an upstanding engagement tab 49 inwardly from their respective free ends as best seen in FIGS. 9 and 10 of the drawings. The engagement tabs 49 are angled outwardly with a surface engagement tab portion 49A which is in end surface co-planar vertical alignment with a corresponding perimeter end surface S of the arms so as to equally engage the aligned inner surface of the manhole indicated at 50 in broken lines in FIG. 11 of the drawings.

A cross support rod 51 extends between respective arm assembly engagement tabs 49 with additional support imparted to the respective arm pairs 42A, 42B, 43A and 43B by multiple reinforcement gussets pairs 52 and 53 as will be well understood by those skilled in the art. A handle 54 is secured to the guide tube pairs 37 and 38 for transport positioning thereof.

Figure 8:
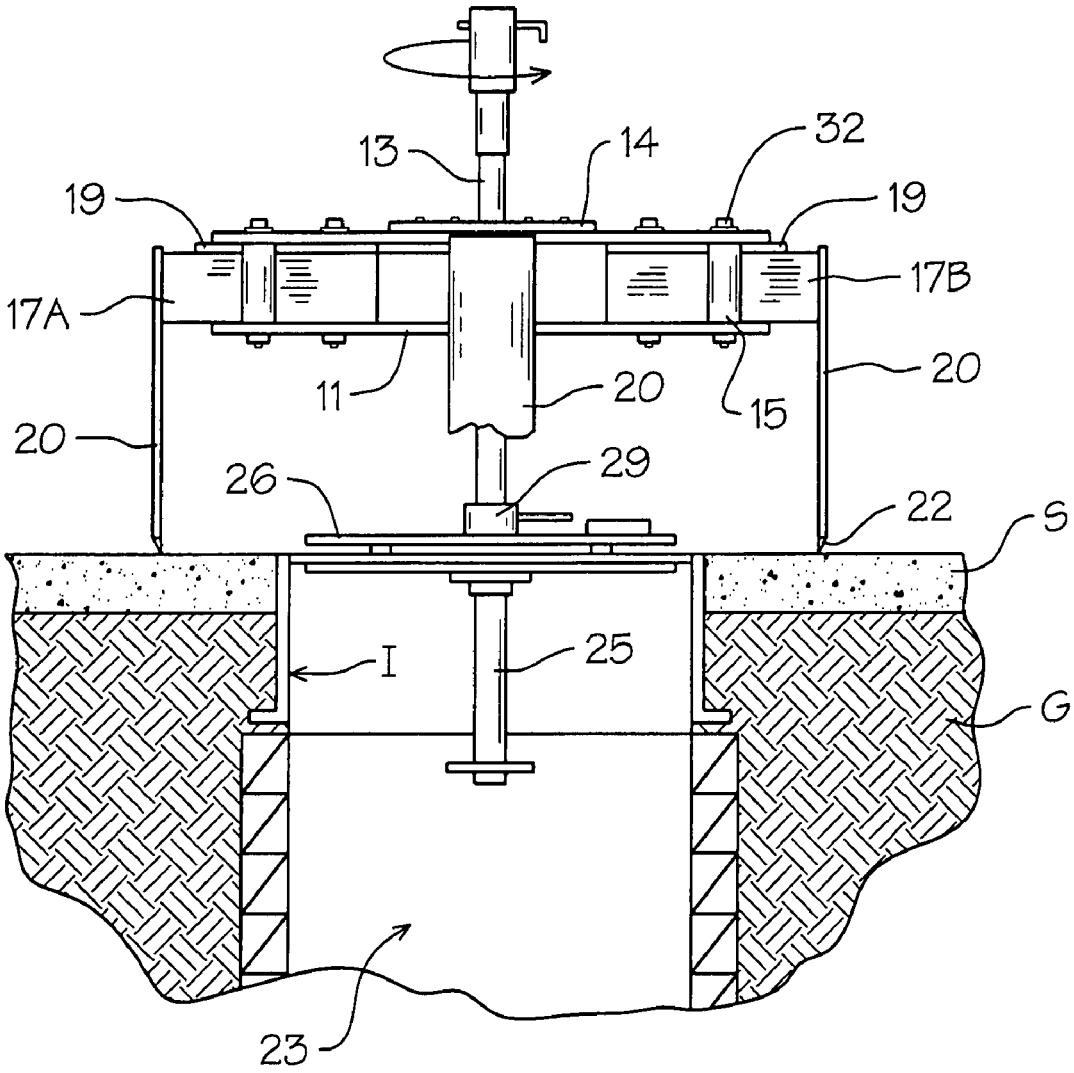
FIG. 8 is a side elevational view with portions shown in section with the invention positioned within a manhole for removal.

A critical aspect of the invention is to provide for adapted use to street environments is a swivel bearing 35 which is secured to the lower mounting plate 27 which will accommodate the angular inclination of the manhole when mounted within as illustrated in FIG. 8 of the drawings.

In use, the manhole removal tool 10 of the invention is connected to a mobile power equipment (not shown) like a backhoe or bobcat type loader having a hydraulic power drive take-off which is well known and understood by those skilled in the art. The effective diameter of the cut to be made about the manhole is determined and the multiple cutting blades 20 are adjusted using the locking nut and bolt assemblies 18 to advance or retract the respective mounting arms 16A and 16B and 17A and 17B in equal increments. The manhole removal tool 10 of the invention is positioned over the manhole 23 as best seen graphically in FIG. 8 of the drawings and lowered with the locking alignment assembly 22 or alternate 35 are adjustably engaged within the interior surface I of the manhole 23 by the extension and engagement in assembly 22 of the hereinbefore described cam elements 28 by use of the deployment guide bolt assemblies 32 within the respective slots 30A, 30B, 30C and 30D or adjustable arm assemblies 42 and 43. As noted, the swivel bearing 31 allows for angular inclination therewith so that the cutting assembly can properly engage the street surface SS which may be of an angular inclination in relation to the orientation of the manhole.

In use with the alternate alignment and locking assembly 35 is positioned on the cutting tool shaft 25 which is then positioned within the open manhole 23. The adjustable engagement arm assemblies 42 and 43 are advanced by rotation of the respective thrust locking nuts 49 on the corresponding threaded rods 47 and 48 with the corresponding upstanding engagement elements 49 thereon frictionally engaging the inner surface 50 of the manhole 23 as noted securing same thereto for removal once the surrounding pavement material has been continuously cut.

As the manhole removal tool 10 is rotated by the power take-off (not shown) the respective support disks 11 and 12 having the multiple extending cutter assemblies 20 thereon will engage and cut into the street surface SS defining a circular cut in spaced relation about the diameter of the manhole 23 to a predetermined depth. The manhole removal tool 10 then removes the manhole 23 and surrounding surface material allowing for preparation and installation of a new manhole assembly by multiple installation step as will be well known and understood by those skilled in the art.

It will thus be seen that a new and novel manhole removal tool 10 of the invention has been illustrated and described and it will be apparent to those skilled in the art that various changes and modifications may be made thereto without departing from the spirit of the invention.

Therefore I claim:

1. A device for securing, cutting, and removing a manhole assembly from a street surface comprising, a cutting assembly for being rotated about a central vertical access to cut a circular slot about a manhole, said cutting assembly having pairs of adjustably extending blade mounting arms, cutting blades depending from each of the free ends of said mounting arms in spaced annular relation to one another, an alignment and extraction assembly selectively secured within said manhole independent of said cutting assembly, oppositely disposed engagement arm elements adjustably extending from said alignment and extraction assembly, a blade drive and extraction shaft extending from said cutting assembly freely through said alignment and extraction assembly.

2. The device for securing, cutting and removal of a manhole set forth in claim 1 wherein a plurality of hardened steel teeth secured to each of said cutting blades.

3. The manhole removing device set forth in claim 1 wherein said alignment and extraction assembly for engagement within the manhole comprises, spaced parallel guide tube pairs, said engagement arm elements comprises spaced parallel tubular members slidably disposed within said respective tube pairs.

4. The manhole removing device set forth in claim 1 wherein said alignment and extraction assembly for extraction is selectively engaged to said cutting assembly by said drive and extraction shaft registerable with a keyed opening in said locking alignment assembly.

* * * * *